US005732692A

United States Patent [19]

Schimmeyer

[11] Patent Number: 5,732,692

[45] Date of Patent: Mar. 31, 1998

[54] VENT DAMPER

[76] Inventor: Werner K. Schimmeyer, 8937 Acorn Pl., Santa Rosa, Calif. 95409

[21] Appl. No.: 617,174

[22] Filed: Mar. 18, 1996

[51] Int. Cl.[6] ..... F23L 3/00

[52] U.S. Cl. ..... 126/285 A; 126/285 R; 126/307 A; 126/80

[58] Field of Search ..... 126/285 A, 285 R, 126/350 R, 307 A, 294, 80; 122/17; 454/20, 27, 334, 37; 110/163

[56] References Cited

U.S. PATENT DOCUMENTS 4,770,160 9/1988 Schimmeyer ..... 126/285

5,239,947 8/1993 Schimmeyer ..... 122/17

*Primary Examiner*—Larry Jones

*Attorney, Agent, or Firm*—Walter A. Hackler

[57] ABSTRACT

An integral vent damper/hood apparatus for regulating draft in a flue of a hot water heater includes a damper support having a hemispherical dome, a congruent cylindrical portion with a plurality of openings therein for passage of flue gas therethrough, and a bottom support. A coaxial faceted guide is disposed between the hemispherical dome and the bottom support with a flue gas floatable damper disposed between the hemispherical dome and the bottom support and moveable along the coaxial faceted guide in response to flue gas exiting the hot water heater flue. The damper includes a coaxial circular aperture therein for enabling the movement of the damper along the faceted guide with contact occurring only at intersections of the guide facets. A hood is provided for conducting flue gas passing through said damper support into an exhaust flue along with a fixture for coaxially attaching the hood and damper support to the hot water heater flue.

16 Claims, 2 Drawing Sheets

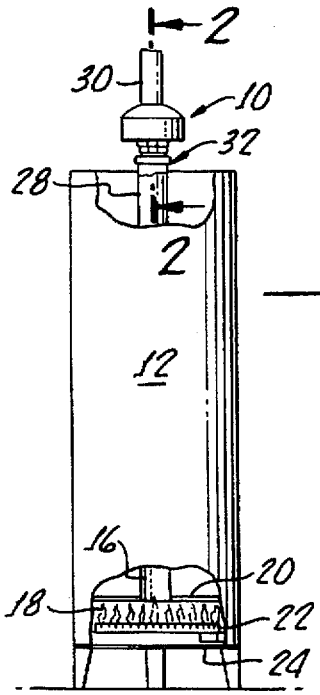
FIG. 1.
FIG. 3.
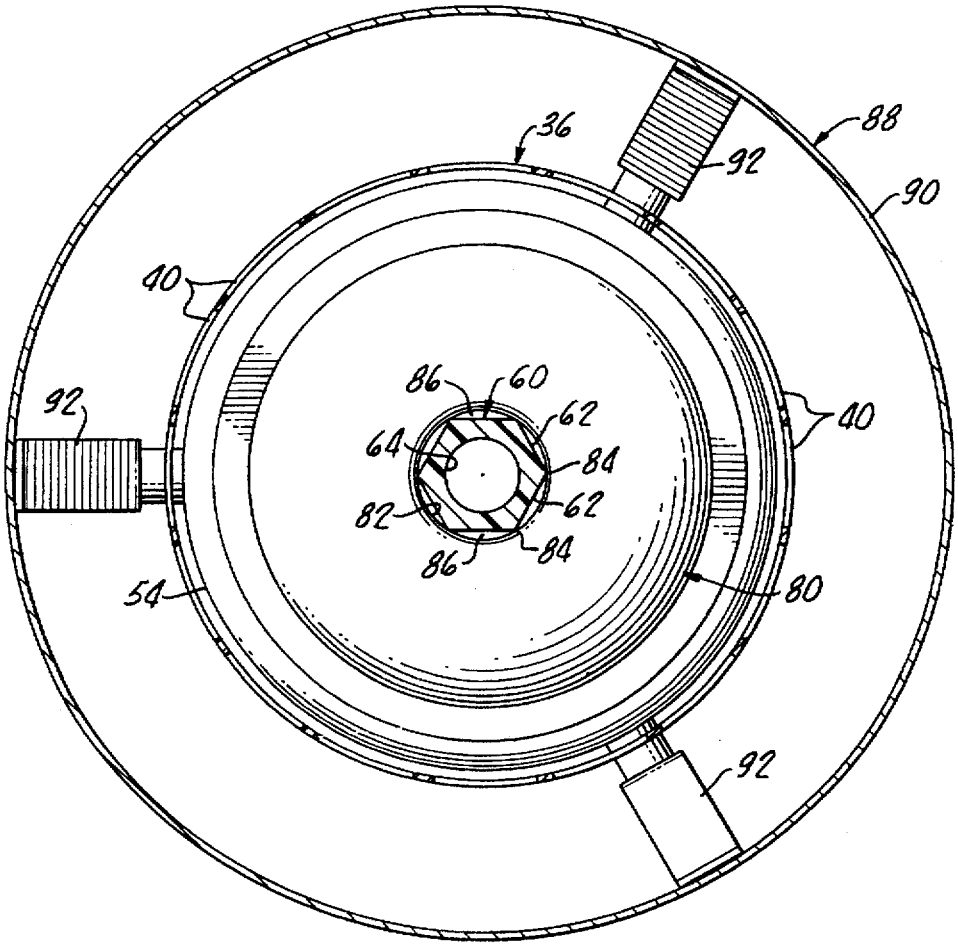

VENT DAMPER

The present invention generally relates to water heating apparatus and is more particularly directed to the control of flue gases from the combustion hot water heater.

Combustion hot water heaters typically utilize gas or oil which is burned in a combustion chamber disposed in a base of a hot water tank. Water heating is effected through the base of the hot water tank and, additionally, through a flue passing through the hot water tank.

In order to reduce energy losses through the flue when the combustion burner is off, dampers have been developed for blocking the flue to prevent cool room air from circulating inside the flue of the hot water heater, thus conserving heat within the water tank. Devices of this type have been described in U.S. Pat. Nos. 4,770,160 and 5,239,947 to Schimmeyer.

In particular, U.S. Pat. No. 4,770,160 discloses a vent damper which is incorporated into an exhaust flue above a hot water heater. The damper comprises a frusto-conical shaped floating poppet that is slidably mounted on a guide within a flue hood immediately above the heater. When the heater burner is in operation, the hot exhaust gases lift the poppet allowing the gas to escape around the poppet and into the flue. When the main burner is turned off, the poppet lowers into a closed position where it rests atop the tank central passageway.

While these devices are effective in restricting the circulation of cool room air through the water heater, the long term operation thereof may result in impaired movement of the poppet due to condensation accumulating between the poppet and the central guide of U.S. Pat. No. 4,770,160 which may cause an accumulation of combustion products, thus inhibiting the free movement of the poppet along the guide.

Additionally, because of the exposed nature of the poppet, damage may occur thereto by handling of the device during installation or undesirable manual manipulation to ascertain its workability and function by installers which, due to the fragile nature of the poppet, may cause early malfunction thereof.

The integral damper/hood apparatus in accordance with the present invention overcomes these problems and accordingly is suitable for successful long-term operation when installed as a combustion water heater.

SUMMARY OF THE INVENTION

An integral vent damper/hood apparatus in accordance with the present invention for regulating draft in a flue of hot water heater generally includes a damper support having a hemispherical dome, a congruent cylindrical portion and a plurality of openings therein which provides a means for passing flue gas therethrough along with a bottom plate.

A coaxial faceted guide is provided between the hemispherical dome and the bottom plate and interconnecting same to house a flue gas floatable damper disposed therein between the hemispherical dome and the bottom plate. The damper is movable along the coaxial faceted guide in response to flue gas exiting from the hot water heater flue.

A damper includes a coaxial circular aperture therein which enables the movement of the damper along the faceted guide with contact only at intersections of the guide facets. In this manner sliding contact is avoided on the guide facets and further space between the facet and the damper along the opening is sufficient to prevent condensation therebetween which prevents the accumulation of combustion gas products which may inhibit the movement of the damper along the guide.

Hood in accordance with the present invention provides means for conducting flue gas passing through the damper into an exhaust flue, and mounting means are provided for coaxially attaching the hood means from the damper support to hot water heater flue. In this manner, positive alignment between the hood and the damper support is maintained.

More particularly, the apparatus in accordance with the present invention includes a bottom plate having a central portion and a plurality of radially extending arms, with each arm having a rise portion extending upwardly from a plane of the central portion and a depending leg portion.

Further, the hood may include a cylindrical side wall having a plurality of legs depending therefrom, with the plurality of cylindrical side wall legs equal in number to the plurality of arm leg portions depending from the bottom plate and radially aligned therewith. This radially alignment facilitates the common mounting of the hood and the damper support.

A mounting means includes a screw extending through each side wall leg and a corresponding radially aligned arm leg portion for clamping the hood means and the damper support to the hot water heater flue.

The damper is disposed for movement from a closed position against the bottom plate to an open position against the hemispherical dome and the damper support openings extend from the bottom plate to a point below the damper when the damper is in the open position against the hemispherical dome. More particularly, the damper support openings have a width of at most one-half inch in order to prevent manual contact with the damper during installation and use of the apparatus.

The faceted guide includes a bore therethrough and the apparatus further includes a cup formed in both the hemispherical dome and the bottom plate which provides a means for compressive engagement with opposite ends of the faceted guide in order to assemble the apparatus. Additionally, a sleeve may be provided for enabling the mounting means to attach the hood means and damper support to another hot water heater flue of different diameter.

BRIEF DESCRIPTION OF THE DRAWINGS

The advantages and features of the present invention will appear in the following description, considered in conjunction with the accompanying drawings:

FIG. 1 is a view of the integral vent damper/hood apparatus in accordance with the present invention as it may be installed on a conventional combustion water heater;

FIG. 3 is a top cross-sectional view of the damper/hood apparatus showing a hexagonal guide for a damper taken along line 3—3 of FIG. 2.

DETAILED DESCRIPTION OF THE DRAWINGS

Figure 2:
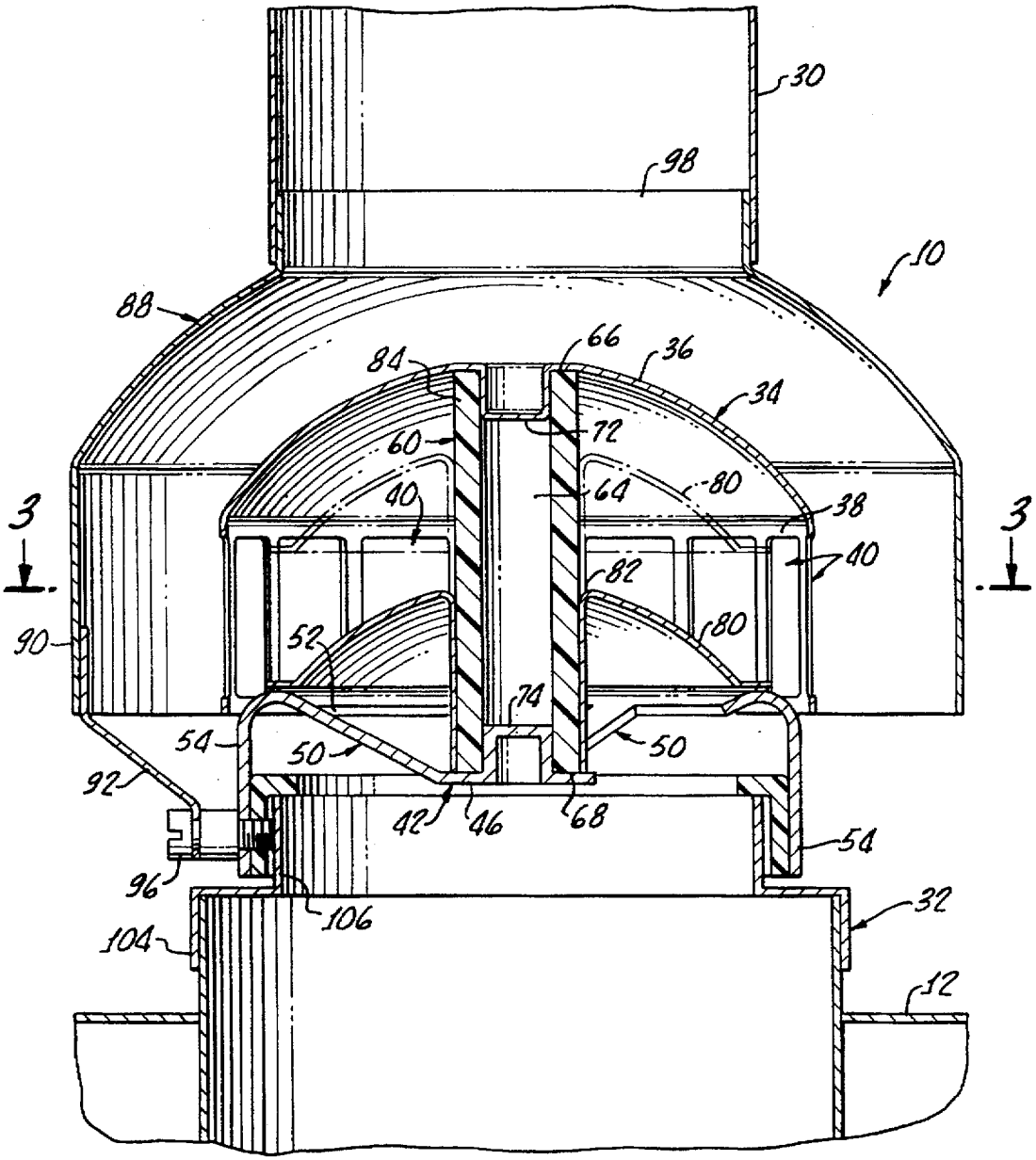
FIG. 2 is a cross-sectional view of the damper/hood apparatus taken along line 2—2 of FIG. 1.

Turning now to FIG. 1, there is shown an integral vent damper/hood apparatus 10 in accordance with the present invention as it may be installed on a combustion hot water heater 12 having a tank 14 with a flue 16 therethrough with a combustion chamber 18 disposed at a bottom 20 of the tank 14 and water heater 12, the combustion chamber 18 having a conventional burner 22 and pilot light 24 disposed therein.

As shown in FIG. 1, the apparatus 10 is connected between an upper end 28 of the water tank flue 16 and an exhaust flue 30 with an adapter 32.

Turning now to FIG. 2, the apparatus 10 generally includes a damper support 34 having a hemispherical dome 36 with a congruant cylindrical portion, or shell, 38 depending therefrom and including a plurality of openings 40 therein which provide for passage of flue gas therethrough. In addition, a bottom support 42 is provided which includes a central portion 46 and a plurality of radially extending arms 50, with each arm having a rising portion 52 connected to a sleeve, or cylinder, portion 54.

Interconnecting the dome 36 and the bottom support 42 is a coaxial faceted guide 60. As shown in FIG. 3 and described hereafter in greater detail, the guide 60 includes a hexagonal shaped perimeter having facets 62. A bore 64 through the guide 60, or alternatively, coaxial opening in ends 60, 68 along with a cup portion 72 formed in the hemispherical dome and a cup portion 74 formed in the central portion 46 of the bottom support 42 provide a means for attaching the hemispherical dome 36, guide 60 and bottom support 42 with one another with a compression fit between the cups 72, 74 and the bore 64 of the guide 60.

The hemispherical dome 36, bottom support 42 and guide 60 may be formed from any suitable material such as, for example, metal, or ceramic.

A flue gas damper 80 is formed from a lightweight material such as aluminum foil, or the like, and as such is floatable along the guide 60 when disposed between the hemispherical dome 36 and the bottom support 42.

The damper 80 is moveable along the coaxial faceted guide 60 in response to flue gas exiting the hot water heater flue, the movement being from a closed position in which the damper 80 is positioned, or seated, against the bottom support 42 to an open position at which the damper 80 is disposed proximate the hemispherical dome 36. In the open position, the damper 80 is disposed above the openings 40 in the cylindrical shell 38.

Importantly, the damper includes a coaxial circular aperture 82 which enables movement of the damper 80 along the faceted guide 60 with contact occurring only at intersections 84 of the guide facets 62. (See FIG. 3). Thus, the relatively small diameter guide, in comparison with the diameter of the damper 80, provides for gaps 86 between the facet 62 and the damper opening 82 to prevent the accumulation of condensation and subsequent attraction of combustion products which may impede the movement of the very light, floatable damper 80 along the guide 60. In addition, the gaps also function to provide exit opening for pilot light exhaust when the damper 80 is closed.

A hood 88, formed from any suitable material such as sheet metal or the like, provides a means for conducting flue gases passing through the damper opening 40 into the exhaust flue 30. The hood 88 includes a cylindrical side wall 90 having a plurality of legs 92 and are secured to the bottom support 42 with clamping screws 96. In addition, the cylinder 54 and legs 92 are radially aligned with one another to enable screws 96 to pass therethrough and threadably engage therewith for clamping in a coaxial manner the damper support 34 and the hood 88 to the upper end 28 of the hot water heater flue 16. An upper end 98 of the hood 88 is sized for sleeving into the exhaust flue 30.

The length of the cylindrical side wall 90 and the common attachment of the hood 88 and vent damper 34 to the upper end 28 of the hot water heater flue 16 provides a means for insuring all exhaust gases from the hot water heater flue 16 are passed to the exhaust flue 30. In addition, the damper support openings 40 are sized, for example, about one-half inch, to prevent inadvertent touching or manipulation of the damper 80 within the damper dome 36, so that deformation of the damper 80 is prevented. Such deformation may occur through undesired manipulation of the damper 80 which may occur during installation of the apparatus 10 or through curiosity of an installer.

In view of the fact that water heaters may utilize either a three or four inch flue, the adapter ring 104 may be provided which can be seated on a four-inch diameter flue 28 by a lower portion 104 and connected with the bottom plate 42 and hood 88 through an upper portion 106 against which the screw 96 can be clamped.

Although there has been hereinabove described a vent damper/hood apparatus in accordance with the present invention, for the purpose of illustrating the manner in which the invention may be used to advantage, it will be appreciated that the invention is not limited thereto. Accordingly, any and all modifications, variations, or equivalent arrangements which may occur to those skilled in the art, should be considered to be within the scope of the invention is defined in the appended claims.

What is claimed is:

1. Integral vent damper/hood apparatus for regulating draft in a flue of a hot water heater, said integral vent damper/hood apparatus comprising:

a damper support having a hemispherical dome and a congruent cylindrical portion with means defining a plurality of openings therein for passage of flue gas therethrough;

a bottom support;

a coaxial faceted guide disposed between said hemispherical dome and said bottom support and interconnecting same, said coaxial faceted guide having intersections between facets thereon;

a flue gas floatable damper disposed between said hemispherical dome and said bottom support and movable along said coaxial faceted guide in response to flue gas exiting the hot water heater flue, the damper being movable from a closed position to an open position in response to the flue gas exiting the hot water heater flue, the damper having means, defining a coaxial circular aperture therein, for enabling the movement of the damper along the faceted guide with contact occurring only at intersections of the guide facets and for establishing gaps between the facets and the circular aperture to enable pilot light exhaust to pass through the gaps with the damper in the closed position;

hood means for conducting flue gas passing through said damper support into an exhaust flue; and mounting means for coaxially attaching said hood means, damper support and bottom support to the hot water heater flue.

2. The integral vent damper/hood apparatus according to claim 1 wherein said bottom support comprises a central portion and a plurality of radially extending arms, each arm having a rise portion extending upwardly from a plane of said central portion to a surrounding cylindrical sleeve.

3. The integral vent damper/hood apparatus according to claim 2 wherein the mounting means comprises screw means, extending through each side wall leg and said bottom support for clamping said hood means and damper support to the hot water heater flue.

4. The integral vent damper/hood apparatus according to claim 3 wherein said damper is disposed for movement from a closed position against said bottom plate to an open position proximate the hemispherical dome above the openings.

5. The integral vent damper/hood apparatus according to claim 4 wherein the damper support openings have a width of at most one-half inch in order to prevent manual contact with the damper during installation and use of the apparatus.

6. The integral vent damper/hood apparatus according to claim 5 wherein the faceted guide comprises means for defining a bore therethrough and further comprising cup means, formed in both the hemispherical dome and the bottom plate, for compressive engagement with opposite ends of the faceted guide in order to assemble the apparatus.

7. The integral vent damper/hood apparatus according to claim 6 further comprising sleeve means for enabling the mounting means to attach the hood means and damper support to another hot water heater flue of different diameter.

8. Integral vent damper/hood apparatus for regulating draft in a flue of a hot water heater, said integral vent damper/hood apparatus comprising:

a damper support having a hemispherical dome;

a bottom support;

a faceted guide coaxially disposed between said hemispherical dome and said bottom support;

a damper disposed between said hemispherical dome and said bottom support and moveable along said coaxial faceted guide in response to flue gas exiting the hot water heater flue, the damper having means, defining a coaxial circular aperture therein, for enabling the movement of the damper along the faceted guide with contact occurring only at intersections of the guide facets and for enabling escape of pilot light gases independent of damper portion along the faceted guide;

hood means for surrounding said damper support and conducting flue gas from the hot water heater flue into an exhaust flue; and mounting means for coaxially attaching said hood means and damper support to the hot water heater flue.

9. The integral vent damper/hood apparatus according to claim 8 wherein said bottom support comprises a central portion and a plurality of radially extending arms, each arm having a rise portion extending upwardly from a plane of said central portion to a cylindrical sleeve.

10. The integral vent damper/hood apparatus according to claim 9 wherein said hood means comprises a cylindrical side wall having a plurality of leg depending therefrom, the plurality of cylindrical side wall legs equaling, in number, the plurality of arm leg portions depending from said bottom plate, and radially aligned therewith.

11. The integral vent damper/hood apparatus according to claim 10 wherein the mounting means comprises screw means, extending through each side wall by and a corresponding radially aligned arm leg portion, for clamping said hood means and damper support to the hot water heater flue.

12. The integral vent damper/hood apparatus according to claim 11 wherein said damper support further comprises a cylindrical portion, congruent with said hemispherical dome and means defining a plurality of openings in said cylindrical portion for passage of flue gas therethrough.

13. The integral vent damper/hood apparatus according to claim 12 wherein said damper is disposed for movement from a closed position against said bottom plate to an open position proximate the hemispherical dome and the damper support openings extend from the bottom plate to a point below the damper when the damper is in the open position proximate the hemispherical dome.

14. The integral vent damper/hood apparatus according to claim 13 wherein the damper support openings have a width of at most one-half inch in order to prevent manual contact with the damper during installation and use of the apparatus.

15. The integral vent damper/hood apparatus according to claim 14 wherein the faceted guide comprises means for defining a bore therethrough and further comprising cup means, formed in both the hemispherical dome and the bottom plate, for compressive engagement with opposite ends of the faceted guide in order to assemble the apparatus.

16. The integral vent damper/hood apparatus according to claim 15 further comprising sleeve means for enabling the mounting means to attach the hood means and damper support to another hot water heater flue of different diameter.

* * * * *